US007381069B2

(12) United States Patent
Saito et al.

(10) Patent No.: US 7,381,069 B2
(45) Date of Patent: Jun. 3, 2008

(54) CARD CONNECTOR HAVING AN EJECTING MEMBER WITH WHICH A CAM FOLLOWER AND A LOCKING MEMBER ARE INTEGRALLY COUPLED

(75) Inventors: Chikara Saito, Tokyo (JP); Joe Motojima, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 11/606,218

(22) Filed: Nov. 29, 2006

(65) Prior Publication Data

US 2007/0207650 A1 Sep. 6, 2007

(30) Foreign Application Priority Data

Nov. 30, 2005 (JP) ..... 2005-346910

(51) Int. Cl.
*H01R 13/62* (2006.01)

(52) U.S. Cl. ..... 439/159

(58) Field of Classification Search ..... 439/159
See application file for complete search history.

(56) References Cited

U.S. PATENT DOCUMENTS 6,537,090 B2 * 3/2003 Ozawa ..... 439/159

FOREIGN PATENT DOCUMENTS

| | | |
|---|---|---|
| EP | 1 729 375 | 12/2006 |
| JP | 3248068 B | 5/1999 |
| JP | 3407194 B | 9/2000 |
| JP | 2005-276676 | 10/2005 |

* cited by examiner

*Primary Examiner*—Javaid Nasri
(74) *Attorney, Agent, or Firm*—Collard & Roe, P.C.

(57) ABSTRACT

For connecting a card, a card connector includes a connector body for receiving the card and an ejecting mechanism adapted to eject the card. The ejecting mechanism includes an ejecting member to be moved together with the card and a cam coupled to the connector body for controlling movement of the ejecting member. The ejecting member includes an ejecting member body guided by the connector body, a cam follower connected to the ejecting member body and guided by the cam, and a locking portion connected to the ejecting member body and displaceable between a first position where movement of the card is locked and a second position where movement of the card is unlocked. The connector body has a receiving portion for maintaining the locking portion at the first position where the ejecting member is located at a specific position.

7 Claims, 8 Drawing Sheets

CARD CONNECTOR HAVING AN EJECTING MEMBER WITH WHICH A CAM FOLLOWER AND A LOCKING MEMBER ARE INTEGRALLY COUPLED

This application claims priority to prior Japanese patent application JP 2005-346910, the disclosure of which is incorporated herein by reference.

BACKGROUND OF THE INVENTION

This invention relates to card connector for use in connecting a card and, in particular, to a push-push type card connector capable of inserting a card into the connector and ejecting the card from the connector by repeating a pushing operation.

Japanese patent (JP-B) No. 3407194 discloses a card connector of the type. The card connector comprises an insulator, a plurality of contacts, a movable plate mounted to the insulator, and a coil spring continuously urging the movable plate in a card ejecting direction. The movable plate has an elastic guide pin. The guide pin has an end portion which serves as a cam follower guided by a cam mechanism formed on the insulator. When a card is inserted into the connector, a forward end of the card is brought into contact with a card contacting portion of the movable plate. When the card is further inserted inward, the movable plate is moved and locked by the cam mechanism. Simultaneously, a plurality of pads formed on the card are electrically contacted with the contacts. When the card is again pushed inward in the connector, the movable plate is moved in the ejecting direction by an urging force of the coil spring to eject the card from the connector. Thus, the movable plate serves as an ejecting member.

However, the above-mentioned card connector does not have means for preventing the card from jumping out. Therefore, the card may unintentionally be jumped out from the connector.

Japanese Patent (JP-B) No. 3248068 discloses another card connector of the type. The card connector has a slider which serves as an ejecting member. The slider is provided with a locking portion which comprises a spring member as a separate component having a protrusion for preventing the card from jumping out.

However, the spring member is a separate component separate from the slider so that the number of components is increased.

SUMMARY OF THE INVENTION

It is therefore an object of this invention to provide a card connector which is reduced in number of components by integrally coupling a cam follower and a locking portion with an ejecting member.

It is another object of this invention to provide a card connector capable of preventing displacement of a locking portion to lock a card to prevent release of the card after the card is connected.

It is still another object of this invention to provide a card connector in which a locking portion is given a card insertion error preventing function.

Other objects of the present invention will become clear as the description proceeds.

According to an aspect of the present invention, there is provided a card connector for connecting a card, the card connector comprising a connector body for receiving the card and an ejecting mechanism coupled to the connector body and adapted to eject the card, the ejecting mechanism comprising an ejecting member to be moved together with the card and a cam coupled to the connector body for controlling movement of the ejecting member, the ejecting member comprising an ejecting member body guided by the connector body, a cam follower connected to the ejecting member body and guided by the cam, and a locking portion connected to the ejecting member body and displaceable between a first position where movement of the card is locked and a second position where movement of the card is unlocked, the connector body having a receiving portion for maintaining the locking portion at the first position where the ejecting member is located at a specific position.

DESCRIPTION OF THE PREFERRED EMBODIMENTS

Figure 1:
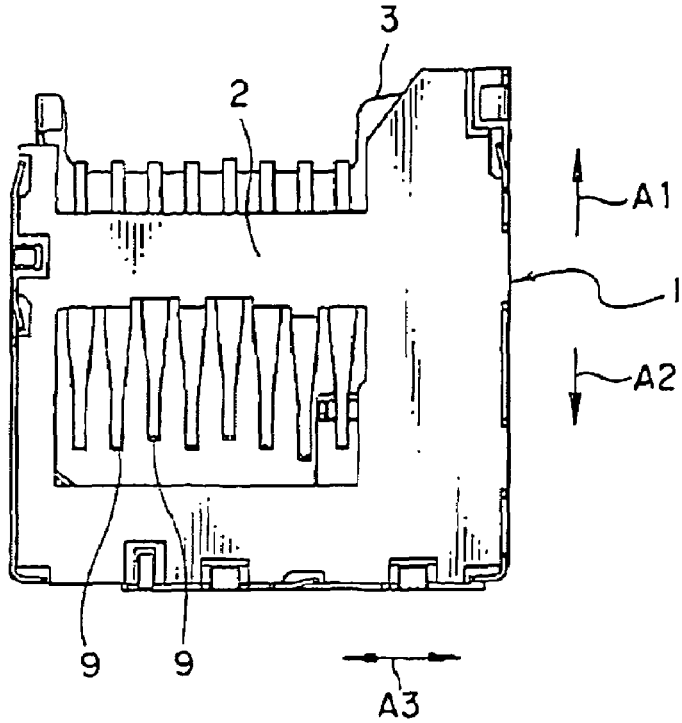
FIG. 1 is a plan view of a card connector according to an embodiment of this invention.
Figure 2:
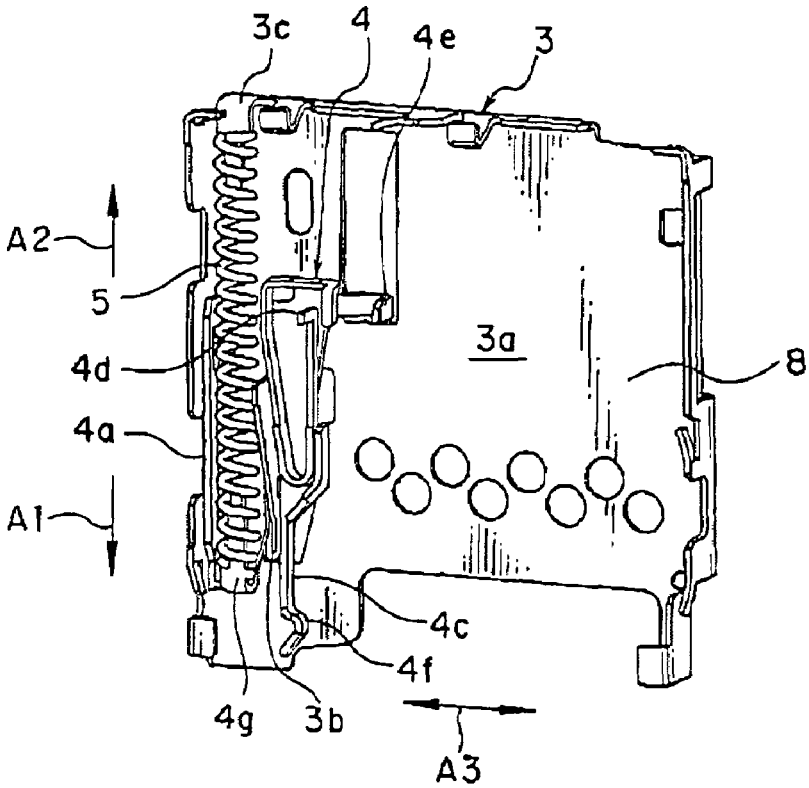
FIG. 2 is a perspective view of a cover of the card connector illustrated in FIG. 1.
Figure 3:
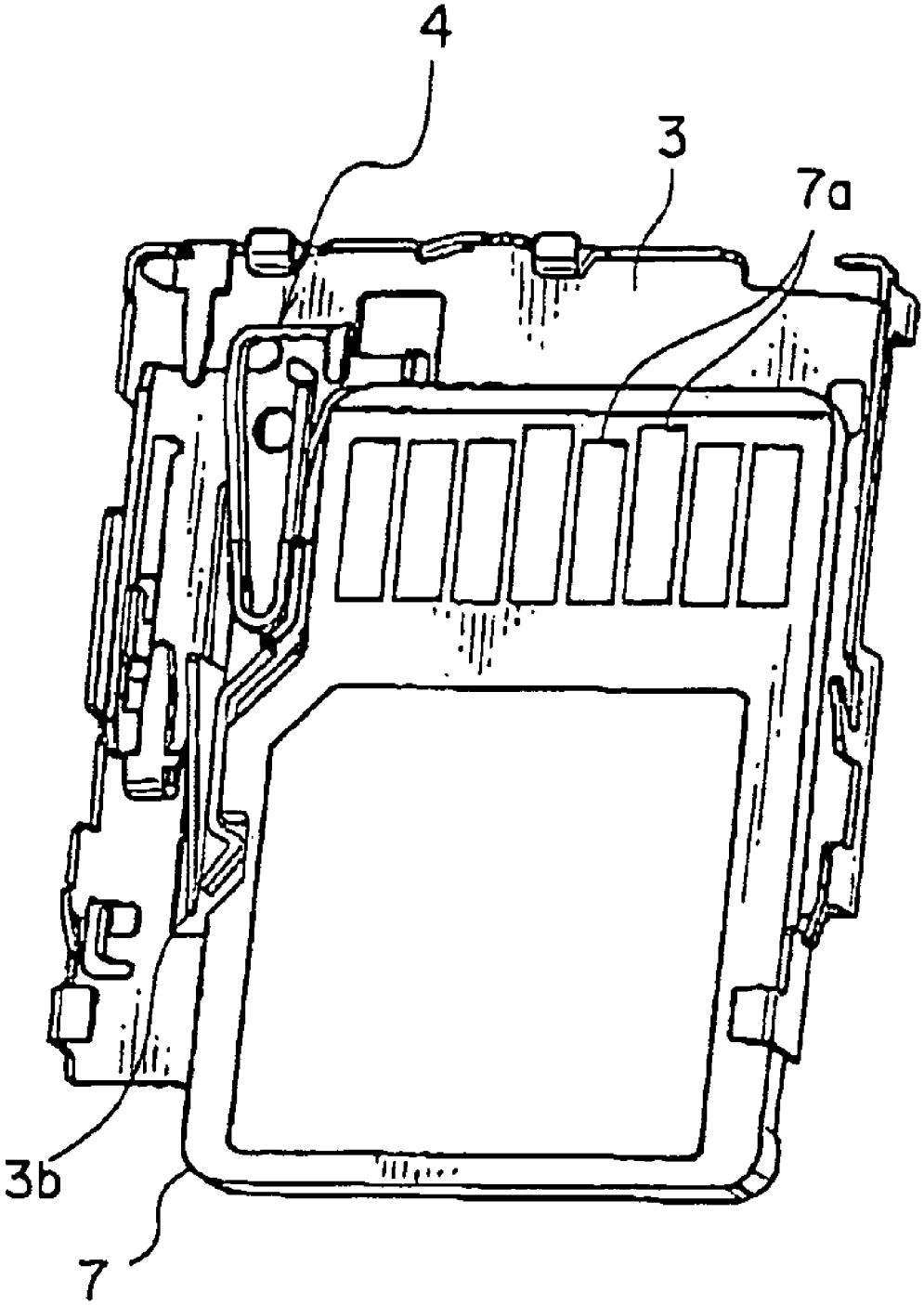
FIG. 3 is a perspective view of the cover illustrated in FIG. 2 together with a card in a state where a compression coil spring is omitted.

Referring to FIGS. 1 to 3, description will be made of a basic structure of a card connector according to an embodiment of this invention.

The card connector 1 illustrated in FIGS. 1 to 3 is a so-called push-push type card connector and comprises a base 2 made of an insulating material and a metal cover 3. The base 2 and the cover 3 are faced to each other in a direction perpendicular to a drawing sheet. A combination of the base 2 and the cover 3 will be called a connector body.

The card connector 1 further comprises an ejecting member 4 made of metal and movable in a first direction A1, and a compression coil spring 5 urging the ejecting member 4 in an ejecting direction, i.e., the first direction A1. The ejecting member 4 and the compression coil spring 5 are fixed to an inner surface 3*a* of the cover 3.

A card 7 is inserted between the base 2 and the cover 3 in a second direction A2 opposite to the first direction A1. Specifically, between the base 2 and the cover 3, a space 8 is defined to receive the card 7. The ejecting member 4 and the compression coil spring 5 are disposed adjacent to the space 8 in a widthwise direction, i.e., a third direction A3 perpendicular to the first and the second directions A1 and A2. The inner surface 3*a* of the cover 3 is provided with a receiving portion 3*b* , comprising a wall portion faced to the ejecting member 4 in the third direction A3 and extending in the first and the second directions A1 and A2.

Figure 5A:
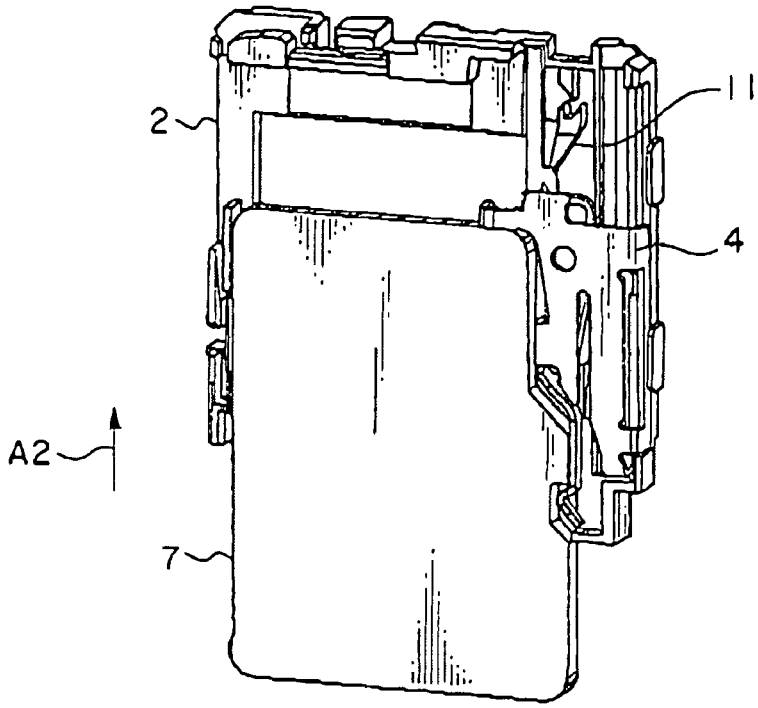
FIG. 5A is a perspective view showing a base and an ejecting mechanism of the card connector in FIG. 1, together with the card which is being inserted.

On the other hand, the base 2 holds a plurality of conductive contacts 9 to be contacted with a plurality of signal patterns 7*a* of the card 7. The contacts 9 are arranged in parallel to one another in the third direction A3. Each of the contacts extends in the first and the second directions A1 and A2. As illustrated in FIG. 5A, the base 2 is provided with a heart cam 11 formed on its inner surface to control movement of the ejecting member 4. A combination of the ejecting member 4 and the heart cam 11 will herein be called an ejecting mechanism. The relationship between the ejecting member 4 and the heart cam 11 will later be described in detail.

Figure 4:
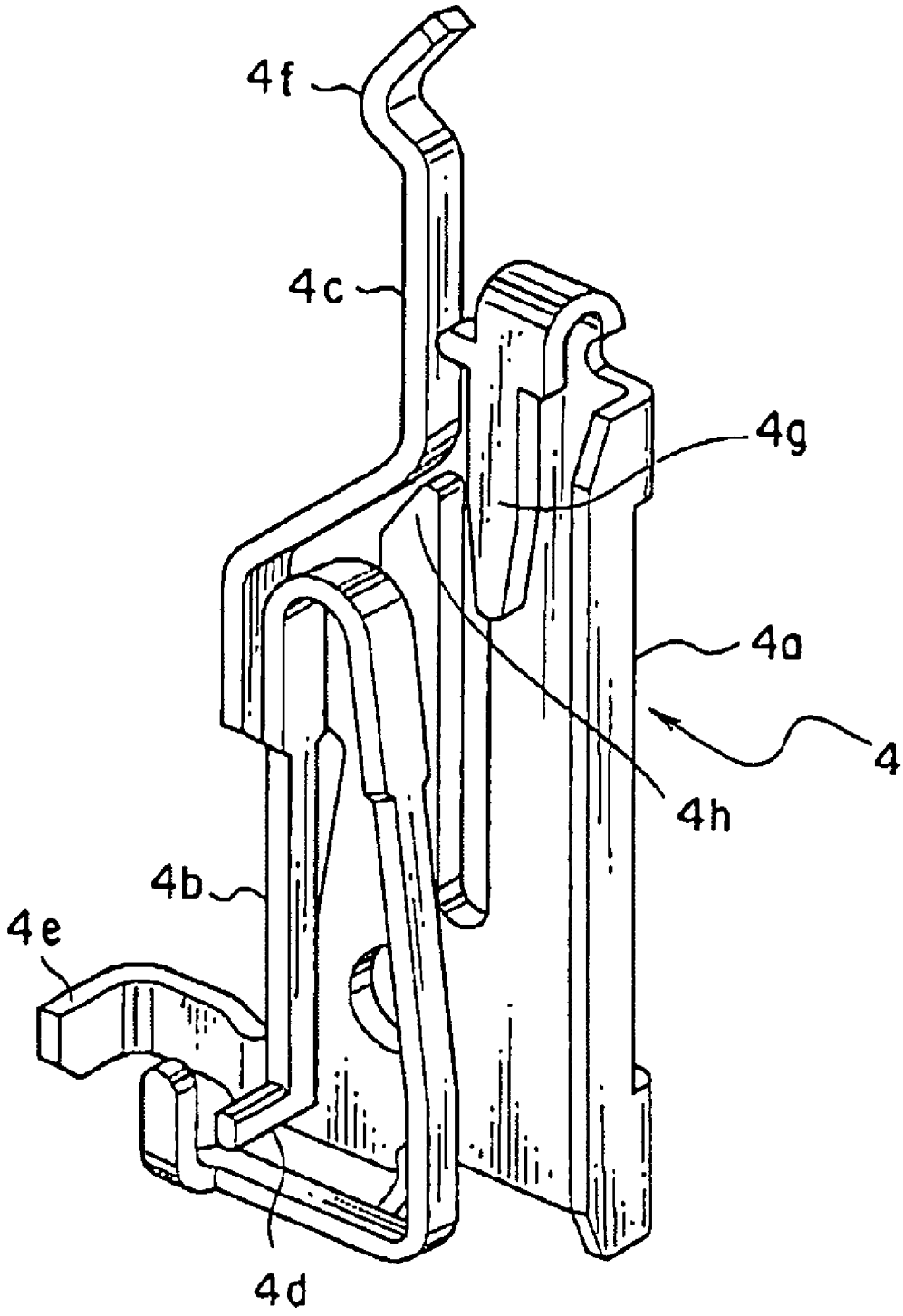
FIG. 4 is a perspective view of an ejecting member of the card connector in FIG. 1.

Referring to FIG. 4, the ejecting member 4 will be described.

The ejecting member 4 comprises an ejecting member body 4*a* guided by the cover 3 and movable in the first and the second directions A1 and A2, a cam follower 4*b*, and an elastically deformable locking member 4*c* for preventing the card 7 (see FIG. 3 and so on) from unintentionally jumping out from the connector 1. The ejecting member body 4*a*, the cam follower 4*b*, and the locking member 4*c* are integrally coupled to form an integral structure. The cam follower 4*b* is elastically deformable and has a free end 4*d* formed at its end to move along the heart cam 11 (see FIG. 5A and so on).

The ejecting member 4 further comprises a contacting portion 4*e* to be contacted with an end portion of the card 7, an engaging portion, i.e., a locking portion 4*f* to be engaged with a recess 7*a* formed on a lateral edge of the card 7, a spring receiving portion 4*g* for receiving the compression coil spring 5, and a receiving portion 4*h* for preventing excessive deformation of the locking member 4*c*. The locking portion 4*f* is formed at an end of the locking member 4*c* and, with elastic deformation of the locking member 4*c*, is displaceable between a first position where it is engaged with the recess 7*a* and a second position where it is disengaged from the recess 7*a*.

Referring to FIGS. 5A to 5C and 6A to 6C in addition, the card connector 1 will continuously be described.

A part near one end of the compression coil spring 5 is fitted over a protruding portion 3*c* formed on the cover 3 by bending. A part near the other end of the compression coil spring 5 is fitted over the spring receiving portion 4*g* of the ejecting member 4. Therefore, the ejecting member 4 is continuously urged by the compression coil spring 5 in the first direction A1 with respect to the connector 1.

The heart cam 11 formed on the base 2 defines a circulating track for the free end 4*d* of the cam follower 4*b*. Specifically, the circulating track has a starting point A, a forward stroke guide portion B inclined with respect to the first and the second directions A1 and A2, a recessed portion C, a backward stroke guide portion D inclined with respect to the first and the second directions A1 and A2, and an end point E, i.e., the starting point A.

Figure 5B:
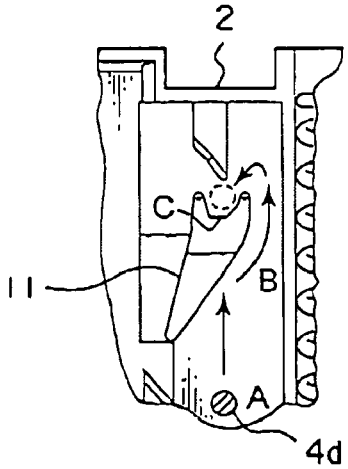
FIG. 5B is an enlarged view of a characteristic part of the base in the state illustrated in FIG. 5A.
Figure 5C:
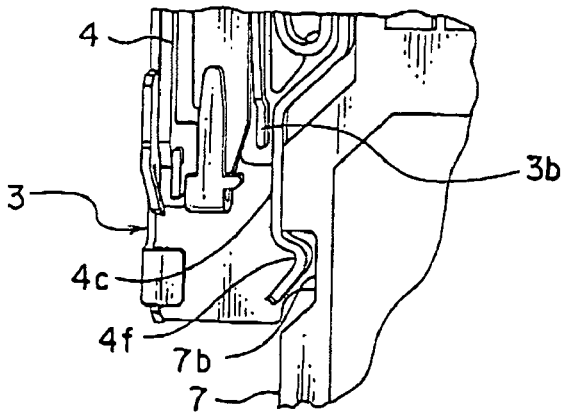
FIG. 5C is an enlarged view of a characteristic part of the cover in the state illustrated in FIG. 5A.

When the card 7 is inserted as shown in FIG. 5A, the locking portion 4*f* of the ejecting member 4 is engaged with an engaged portion, i.e., a recessed portion 7*b* of the card 7 as shown in FIG. 5C. In this state, when the card 7 is pushed by a finger or the like in the second direction A2, the ejecting member 4 moves in the second direction A2 following the card 7, with compression of the compression coil spring 5. As a result, as shown in FIG. 5B, the free end 4*d* of the ejecting member 4 moves from the starting point A, passes along the forward stroke guide portion B, and reaches a position depicted by a dashed-line circle in the recessed portion C.

Thereafter, when the finger or the like is released from the card 7, the free end 4*d* of the ejecting member 4 is engaged with the recessed portion C of the heart cam 11 by a restoring force of the compression coil spring 5. As a consequence, the ejecting member 4 is locked.

Figure 6A:
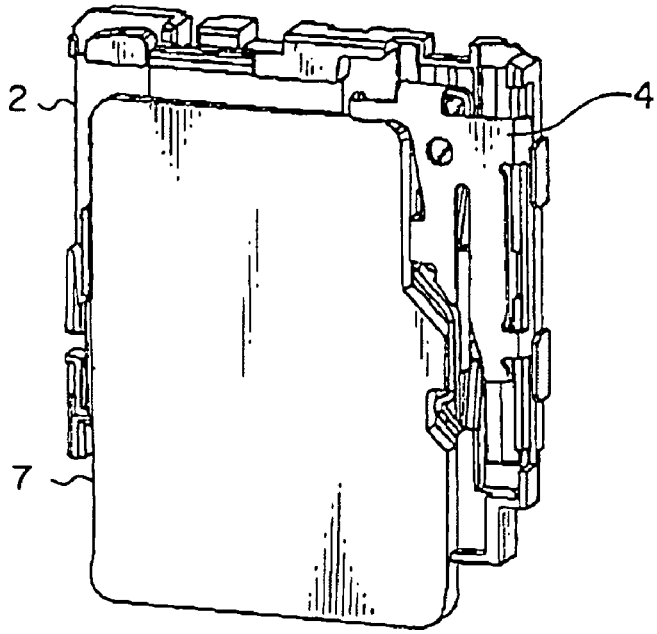
FIG. 6A is a perspective view of the base and ejecting mechanism of the card connector in FIG. 1, together with the card which is completely inserted.
Figure 6B:
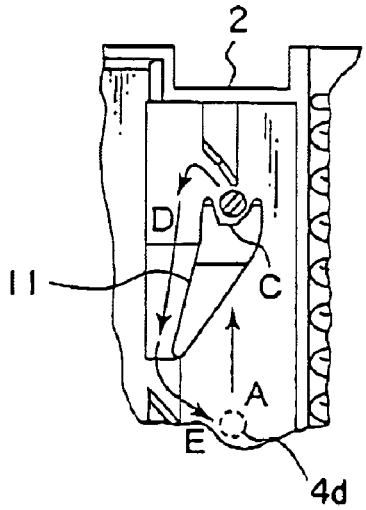
FIG. 6B is an enlarged view of a characteristic part of the base in the state in FIG. 6A.
Figure 6C:
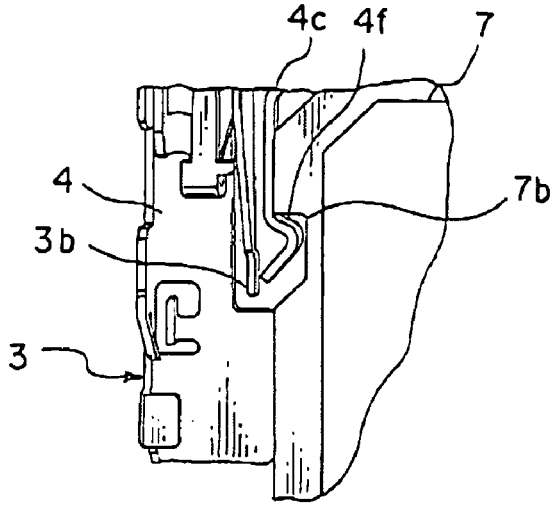
FIG. 6C is an enlarged view of a characteristic part of the cover in the state in FIG. 6A.

Further, the locking member 4*c* and the locking portion 4*f* of the ejecting member 4 reach a position faced to the receiving portion 3*b* in the third direction A3 as shown in FIG. 6C. Therefore, the locking member 4*c* is prevented from elastic deformation. Accordingly, the locking portion 4*f* and the recessed portion 7*a* of the card 7 are not disengaged from each other so that the card 7 is locked also. In this state, the signal patterns 7*a* of the card 7 are contacted with the contacts 9 so that the card 7 is electrically connected to the connector 1.

When the card 7 is again pushed in the second direction A2 by the finger or the like, the free end 4*d* of the ejecting member 4 is released from the recessed portion C. Therefore, by the restoring force of the compression coil spring 5, the free end 4*d* of the ejecting member 4 passes along the backward stroke guide portion D and returns to a position depicted by a dashed-line circle at the end point E, i.e., at the starting point A. Consequently, the card 7 moves in the first direction A1 also. At this time, the locking portion 4*f* is engaged with the recessed portion 7*a* of the card 7 so that the card 7 is prevented from being unintentionally jumped out from the connector 1.

As a result of movement of the card 7 in the first direction A1, the locking portion 4*f* of the ejecting member 4 is apart from the receiving portion 3*b* as illustrated in FIG. 5C. Therefore, by pulling the card 7 in the first direction A1, engagement between the locking portion 4*f* and the recessed portion 7*a* of the card 7 is easily released so that the card 7 is allowed to be pulled out from the connector 1.

In the foregoing, the receiving portion 3*b* is formed on the cover 3. However, the receiving portion 3*b* may be formed at any appropriate position of the base 2.

Figure 7:
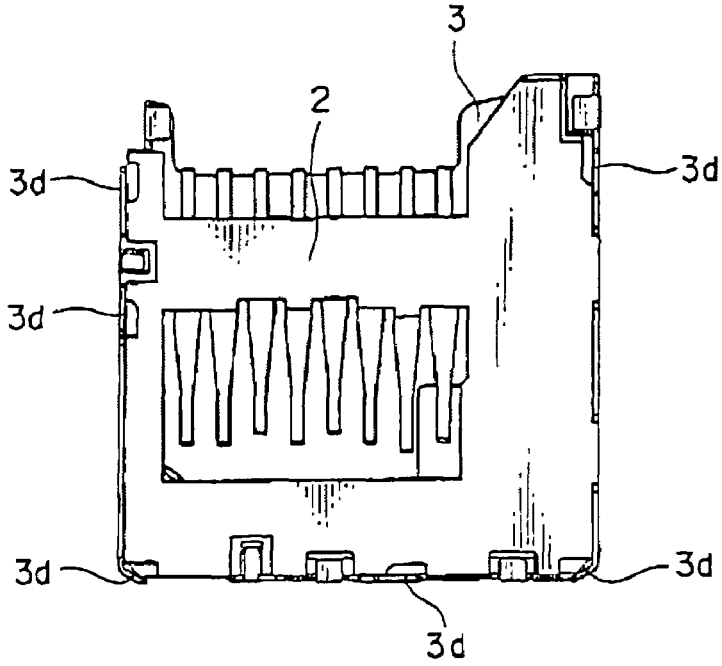
FIG. 7 is a plan view showing a half-assembled state of the card connector, for describing a structure of fixing the cover to the base.

Referring to FIG. 7, description will be made of a structure of fixing the cover 3 to the base 2.

As illustrated in FIG. 7, the cover 3 is fitted to the base 2. Thereafter, six bending legs 3*d* are bent to fix the cover 3 to the base 2.

Figure 8A:
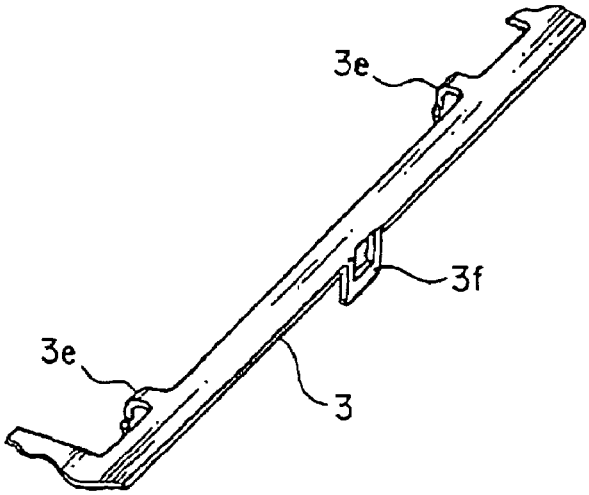
FIG. 8A is a perspective view showing a characteristic part of the cover in another structure of fixing the cover to the base.
Figure 8B:
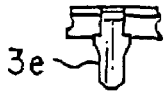
FIG. 8B is a front view of a part of FIG. 8A.
Figure 9:
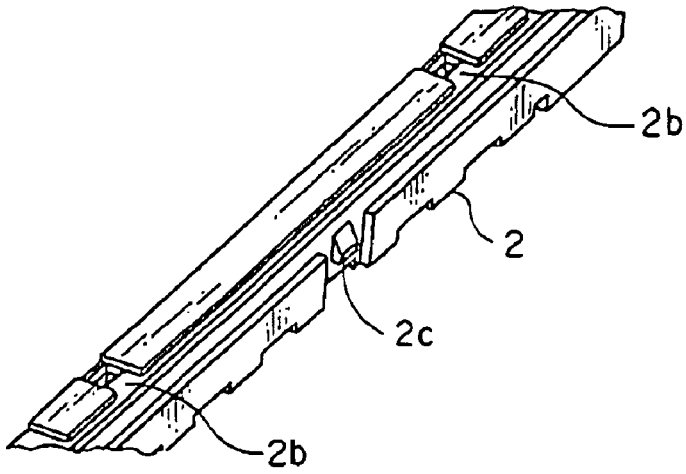
FIG. 9 is a perspective view of a characteristic part of the base corresponding to the cover illustrated in FIG. 8A.
Figure 10:
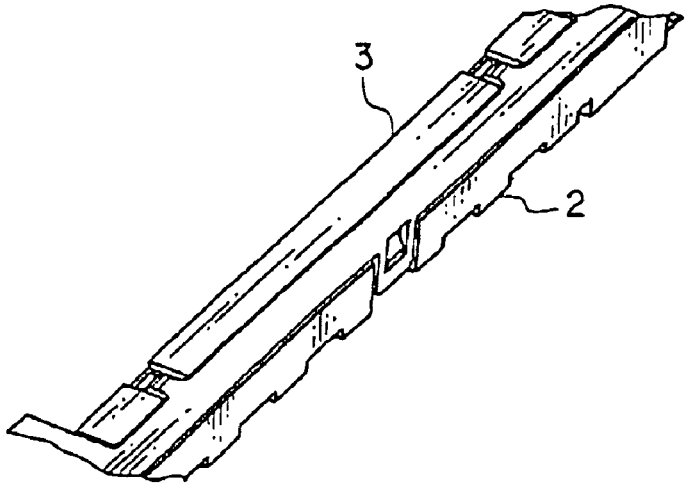
FIG. 10 is a perspective view of a characteristic part of the card connector using the cover in FIG. 8A and the base in FIG. 9.

Referring to FIGS. 8 to 10, description will be made of another structure of fixing the cover 3 to the base 2.

As shown in FIGS. 8A and 8B, the cover 3 has protruding portions 3*e* formed at two inner positions on each of left and right side portions thereof and a protruding portion 3*f* formed at one outer position of each of the left and the right side portions thereof. On the other hand, as illustrated in FIG. 9, the base 2 has recessed portions 2*b* formed at two inner positions on each of left and right side portions thereof and a raised portion 2*c* formed at one outer position of each of left and right side portions thereof. The protruding portions 3*e* are press-fitted into the recessed portions 2*b*. The protruding portion 3*f* is latched to the raised portion 2*c*. As a result, the state illustrated in FIG. 10 is reached.

Figure 11:
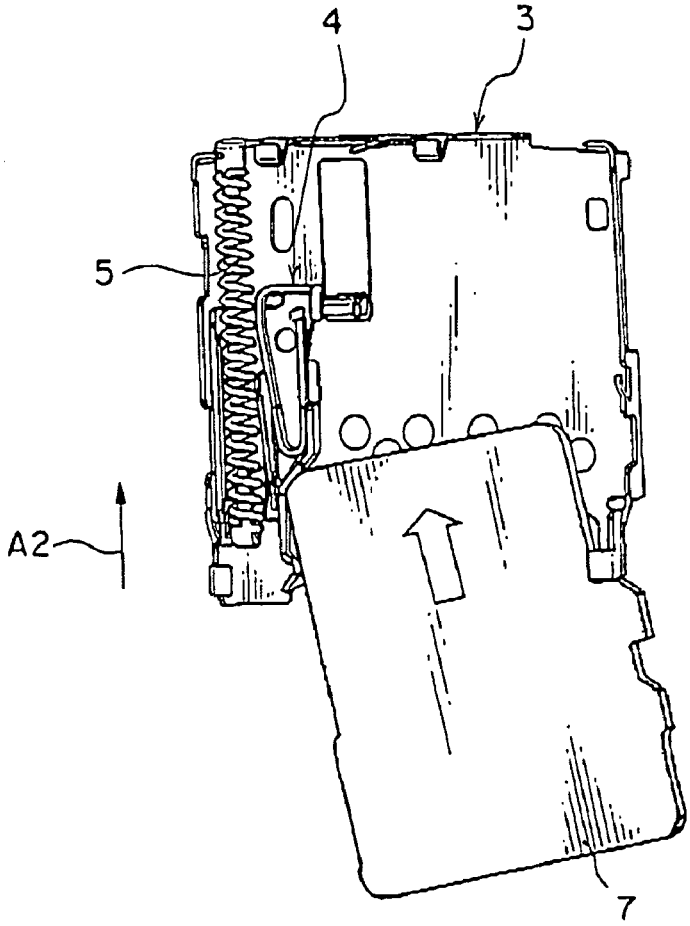
FIG. 11 is a view for describing a state where the card is erroneously inserted.
Figure 12:
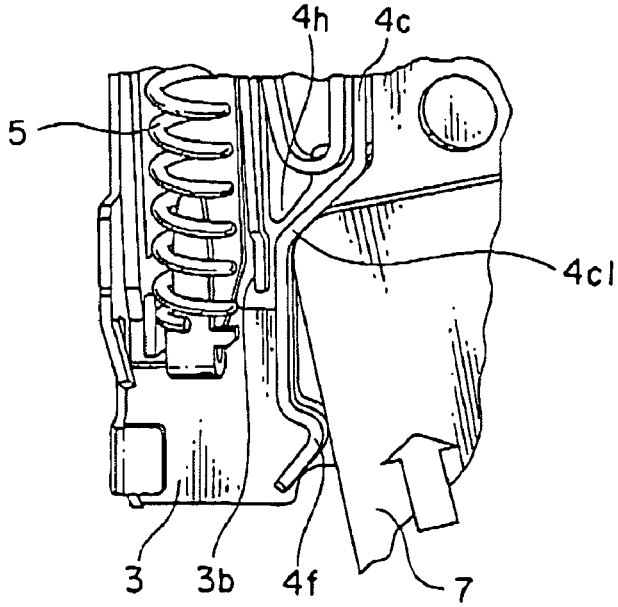
FIG. 12 is an enlarged view of a characteristic part of FIG. 11.

Referring to FIGS. 11 and 12, description will be made of the case where the card 7 is improperly or erroneously inserted into the connector 1 in a position inclined with respect to the second direction A2. Herein, erroneous insertion collectively includes insertion of the card 7 into the connector 1 in an inclined position, insertion in an upside-down position, and insertion in a frontward-back position.

In FIGS. 11 and 12, a front left corner of the card 7 is contacted with a bent portion 4*c*1 of the locking member 4*c*. When the bent portion 4*c*1 is pushed by the card 7, a part around the bent portion 4*c*1 is brought into contact with the receiving portions 3*b* and 4*h*. Therefore, the locking member 4*c* is prevented from further elastic deformation so that the card 7 is prevented from being erroneously inserted into the connector 1.

While the present invention has thus far been described in connection with the preferred embodiment thereof, it will readily be possible for those skilled in the art to put this invention into practice in various other manners.

What is claimed is:

1. A card connector for connecting a card, the card connector comprising: a connector body for receiving the card; and an ejecting mechanism coupled to the connector body and adapted to eject the card; the ejecting mechanism comprising: an ejecting member to be moved together with the card; and a cam coupled to the connector body for controlling movement of the ejecting member; the ejecting member comprising: an ejecting member body guided by the connector body for ejecting the card from the card connector; a cam follower connected to the ejecting member body and guided by the cam; a locking portion connected to the ejecting member body and displaceable between a first position where movement of the card is locked and a second position where movement of the card is unlocked, the connector body having a first receiving portion for maintaining the locking portion at the first position where the ejecting member is located at a specific position; and a second receiving portion formed integral with the ejecting member body; wherein the specific position corresponds to a position where the card is connected to the connector, wherein the ejecting member has a spring portion elastically supporting the locking portion on the ejecting member body, the spring portion urging the locking portion towards the first position, and wherein the locking portion is brought into contact with the second receiving portion when the card is inserted, thereby preventing erroneous insertion of the card.

2. The card connector according to claim 1, wherein the connector body includes a cover coupled to the ejecting member, the receiving potion being formed on the cover.

3. The card connector according to claim 2, wherein each of the ejecting member and the cover is made of metal.

4. The card connector according to claim 1, wherein the connector body includes a base and a cover faced to each other to define a space formed therebetween to receive the card, the ejecting mechanism being disposed between the base and the cover to be adjacent to the space.

5. The card connector according to claim 1, wherein the base is made of an insulating material, each of the ejecting member and the cover being made of metal.

6. The card connector according to claim 5, wherein the ejecting member is formed on the cover and the cam is formed on the base.

7. The card connector according to claim 1, wherein the locking portion and the receiving portion are contacted with each other when the card is inserted, thereby preventing erroneous insertion of the card.

* * * * *